United States Patent [19]

Ehrlich

[11] Patent Number: 4,958,472

[45] Date of Patent: Sep. 25, 1990

[54] COMPOSITE TRAILER SIDEWALL

[75] Inventor: Rodney P. Ehrlich, Monticello, Ind.

[73] Assignee: Wabash National Corporation, Lafayette, Ind.

[21] Appl. No.: 358,665

[22] Filed: May 30, 1989

[51] Int. Cl.[5] ..... E04C 1/00; E04C 2/32

[52] U.S. Cl. ..... 52/584; 52/586; 52/592

[58] Field of Search ..... 52/309.9, 309.1, 309.11, 52/586, 584, 582, 592

[56] References Cited

U.S. PATENT DOCUMENTS 3,075,253 1/1963 Hammitt et al. ..... 52/586

4,373,313 2/1983 Nash, Jr. ..... 52/592

4,837,999 6/1989 Stayner ..... 52/309.11

*Primary Examiner*—David A. Scherbel

*Assistant Examiner*—Michele A. Van Patten

*Attorney, Agent, or Firm*—Richard Bushnell

[57] ABSTRACT

The present invemntion relates to a composite sidewall for a trailer body or the like. The composite sidewall includes a plurality of core members sandwiched between first skin members having overlapping edges and second skin members having overlapping edges and a splicing bar abutting the adjacent core members and covering the overlapping edges of the first and second skin members.

9 Claims, 1 Drawing Sheet

COMPOSITE TRAILER SIDEWALL

BACKGROUND OF THE INVENTION

The present invention relates generally to a sidewall for a trailer body or the like, and more particularly, the invention relates to composite panels for trailer bodies comprising a plurality of upstanding plastic core members sandwiched between thin metal skins.

Trailers and the like of the general type disclosed herein are well known and include a variety of types of trailer sidewalls. A typical well known construction is a plate-type trailer which includes aluminum sideposts. Aluminum plate-type trailer constructions are desirable because they increase the strength and rigidity of the sidewalls while at the same time increase the inside width of the trailer body. Generally, it is desirable to have a relatively thin trailer sidewall so that the total inside dimensions of the trailer body can be increased to carry the optimum amount of cargo. Aluminum heretofore has been considered a desirable material to use for sidewalls because it is relatively resilient, strong and light in weight. However, the cost to make a trailer having aluminum sidewalls has become expensive in recent years.

Accordingly, a general object of the present invention is to provide a new and improved sidewall assembly for use in a trailer body, which sidewall assembly is simple in design and economical to manufacture while at the same time providing maximum inside dimensions of the trailer body.

A further object of the present invention is to provide a novel sidewall which provides desired strength and rigidity.

A more particular object of the present invention is to provide a novel sidewall having composite panels which include a plurality of plastic core members sandwiched between thin metal skins and having a hard plastic splicer bar at each seam.

These and other objects and features of the present invention will become more apparent from the reading of the following descriptions.

SUMMARY OF THE INVENTION

The present invention is for use in a trailer or the like having a body including side panels, a roof and a floor. The trailer body includes composite sidewall panels having a core member sandwiched between first skin members having overlapping edges and second skin members having overlapping edges and joinder means abutting adjacent core members and covering the overlapping edges of the first and second skin members.

BRIEF DESCRIPTION OF THE DRAWINGS

The features of the present invention which are believed to be novel are set forth with particularity in the appended claims. The organization and manner of operation of the invention, together with further objects and advantages thereof, may best be understood by reference to the following description taken in connection with the accompanying drawings in which:

DETAILED DESCRIPTION OF THE ILLUSTRATED EMBODIMENT

Figure 1:
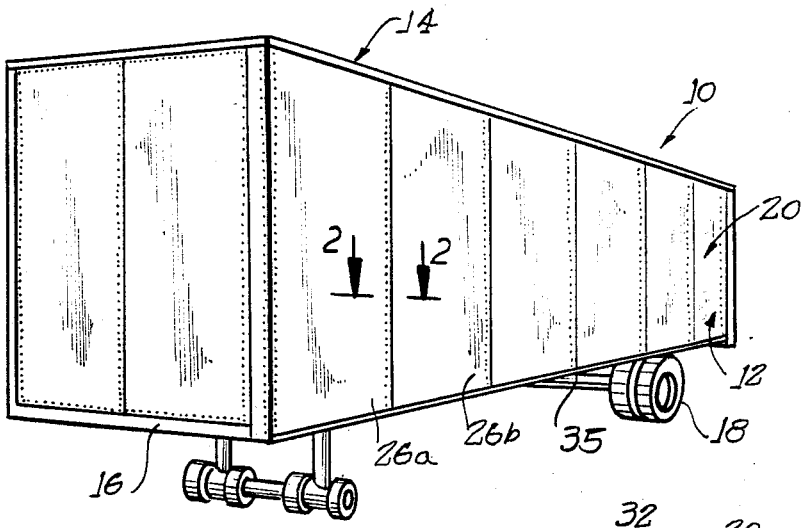
FIG. 1 is a perspective view showing a trailer body structure incorporating the features of the present invention.

Turning now to the drawings, wherein like components are designated by like reference numerals throughout the various figures, a trailer body constructed in accordance with the present invention, is shown in FIG. 1 and generally designated by reference numeral 10.

The trailer body 10, includes rectangular sidewall 12, a top panel or roof 14 and a floor assembly (not shown) the floor assembly and lower portion of the side panels 12 are suitably secured to a lower frame assembly 16 and are supported by a rear wheel assembly 18.

The sidewall 12 includes a plurality of vertical upstanding composite side panels 20. The composite side panels 20 include a plurality of adjacent core members 22 sandwiched between a plurality of adjacent inside or first thin metal skins or members 24*a* and 24*b* and outside or second thin metal skins or members 26*a* and 26*b* and bonded thereto by a suitable known adhesive.

In the embodiment shown, each core member 22 is preferably approximately .187 inches thick. The core members 22 are preferably made of some type of compressible plastic material such as polypropylene or polyethylene. It is to be noted that these materials are relatively inexpensive as compared to aluminum found in prior trailer wall constructions. However, in view of the fact that the plastic materials identified above are compressible the core members would be likely to weaken or buckle if suitable fastener means were inserted therethrough.

Figure 2:
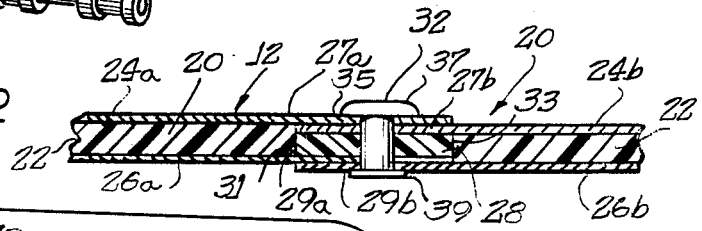
FIG. 2 is an enlarged fragmentary sectional view of the trailer sidewall taken along line 2—2 in FIG. 1.
Figure 3:
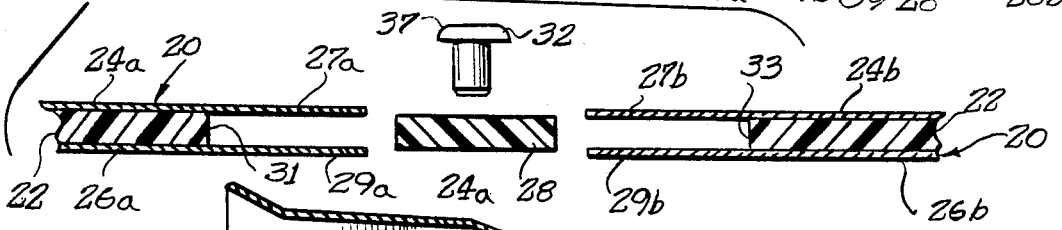
FIG. 3 is an exploded view of FIG. 2.
Figure 4:
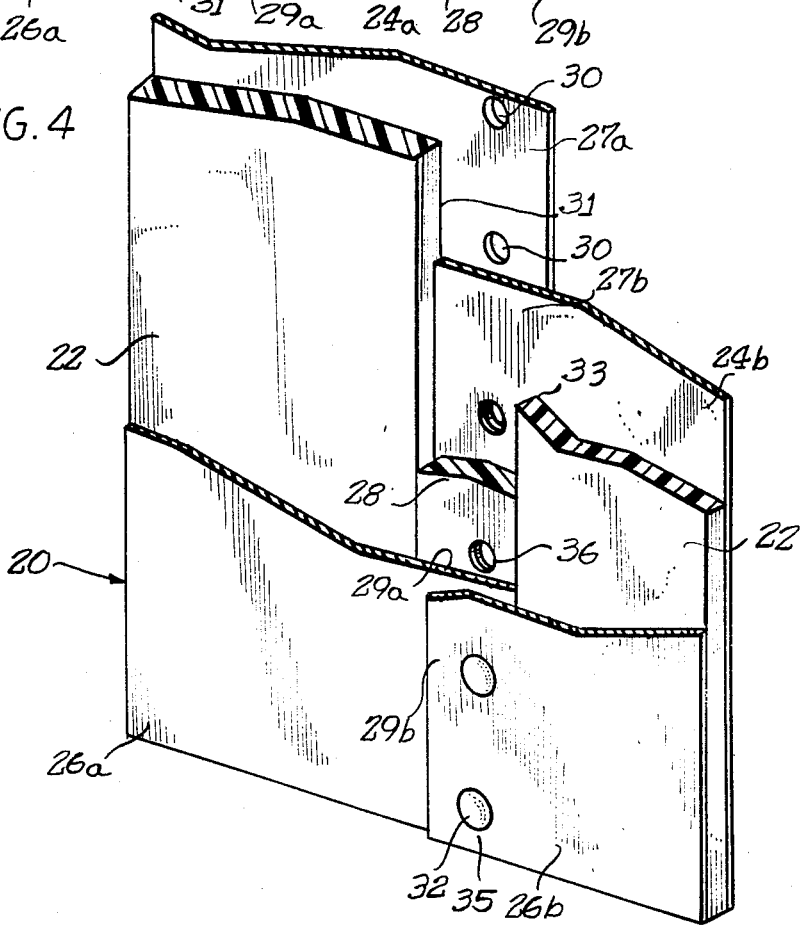
FIG. 4 is an enlarged partially broken away perspective view of a portion of the sidewall of the trailer body.

Thus, as shown best in FIGS. 2 and 4 adjacent core members 22 are joined by a splicing bar or joinder means 28. Splicing bar 28 will be discussed in detail below.

The first metal skin members 24*a* and 24*b* and the second metal skin members 26*a* and 26*b* are preferably approximately 0.026 inches thick. Each of the skin member is wider than its associated core 22 so as to present end or vertical marginal or edge portions 27*a*, 27*b*, 29*a* and 29*b* projecting freely beyond corresponding adjacent edges 31 and 33 of the core members 22. Each skin member includes a plurality of vertically spaced preformed apertures 30 through each end or vertical edge portion 27*a*, 27*b*, 29*a* and 29*b* of each skin member for each skin member for receiving rivets or other fastener means 32.

As shown best in FIG. 4 the first metal skin member edge portion 27*a* overlaps and overlies the first metal skin member edge portion 27*b*. The second skin member edge portions 29*a* and 29*b* overlap each other in the opposite direction from the overlapping first skin member edge portions 27*a* and 27*b*. In other words, the second skin member edge portion 29*a* underlies second skin member edge portion 29*b*. The overlapping portions of the skin members 24*a* and 24*b* and 26*a* and 26*b* form a seam 35 which is preferably approximately one inch wide.

In addition, the first skin members 24*a* and 24*b* and the second skin members 26*a* and 26*b* overlap so that the apertures 30 of skin members 24*a* and 24*b* align with each other and with apertures 30 of skin members 26*a* and 26*b*.

The splicing bar 28 is approximately the same width as seams 35. As previously indicated the splicing bar 28 is positioned between adjacent core members 22 and abuts edges 31 and 33 so that splicing bar 28 is covered by the projecting and overlapping marginal portions 27*a*, 27*b*, 29*a* and 29*b* of the first skin members 24*a* and 24*b* and the second skin members 26*a* and 26*b*. Splicing bar 28 also includes a plurality of vertically spaced apertures 36 which are aligned with apertures 30 in first and second skin members.

Splicing bar 28 is thinner than the core members by approximately the thickness of one skin member or .026 inches. Thus, the side panel 20 will not bulge at the seams 35.

Fasteners 32 extend through apertures 30 of the first skin members 24*a* and 24*b* and second skin members 26*a* and 26*b* and aperture 36 of splicing bar 28. As shown in FIG. 2, the fasteners 32 may be rivets or bolts having opposite end heads or enlargements 37 and 39 which tightly clamp the sheet members and the bar 28 therebetween.

The splicing bar 28 is preferably made of a hard non-compressible plastic material or a reinforced plastic bar that will not compress or bulge or weaken when fastener means 32 extend therethrough and are tightened so as to aggressively clamp the marginal portions of the skin members and the splicing bar together. Thus, adjacent panels 20 are securely and rigidly interconnected so that loads and stress may be transmitted not only through the fasteners 32 and the skin members 24*a* and 24*b* and 26*a* and 26*b*, but also through abutting edges of the splicing bar 28 and the core members 22.

While a particular embodiment of the invention has been shown, it should be understood, of course, that the invention is not limited thereto since many modifications may be made. It is, therefore, contemplated to cover the present invention and any such modifications as follows in the true spirit and scope of the appended claims.

I claim:

1. A sidewall for use in a trailer body or the like, said sidewall comprising at least one core member sandwiched and bonded between at least a pair of first skin members having overlapping edges and at least a pair of second skin members having overlapping edges, and joinder means abutting adjacent core members and being covered by said overlapping edges of said first and second skin members, said first and second skin members including a plurality of vertically spaced apertures adjacent each edge of said skin member and said joinder means including a plurality of vertically spaced apertures, said apertures of said joinder means aligning with said apertures in said first and second skin members and said fastener means extending through said apertures in said joinder means and said first and second skin members thereby securing said skin members to said joinder means.

2. A composite sidewall of claim 1 wherein said joinder means is thinner than said core members by approximately the thickness of one of said skin members.

3. A composite sidewall of claim 2 wherein said first skin members overlap each other in one direction and said second skin members overlap each other in a direction opposite from said first skin members.

4. A composite sidewall of claim 1 wherein said core members are made of a compressible plastic material and said joinder means are made of a substantially non-compressible material.

5. A composite sidewall of claim 1 wherein said skin members are made of metal.

6. A sidewall for use in a trailer body or the like, said sidewall comprising a plurality of vertically upstanding plastic core members sandwiched between a plurality of first metal skin members having edges that overlap each other in one direction, and a plurality of second metal skin members having edges that overlap each other in a direction opposite from said first skin members, said first and second skin members having a plurality of vertically spaced apertures adjacent each edge of said skin members, and a joinder means abutting adjacent core members and having a plurality of vertically spaced apertures aligned with said apertures of said first skin members and said second skin members, and fastener means extending through said apertures of said first skin member and said joinder means and said second skin member for securing said skin members to said core members and said joinder means.

7. A sidewall of claim 6 wherein said core members extend vertically the length of the sidewall.

8. A sidewall of claim 6 wherein the width of the joinder means is less than the width of said core members by approximately the width of one of said skin members.

9. A sidewall of claim 6 wherein said core members comprise a compressible material and said jonder means comprises a bar of relatively incompressible material, and said fastening means comprises fasteners having enlargements at opposite ends tightly clamping said skin members and said bar therebetween.

* * * * *